US008162029B2

(12) United States Patent
Ha

(10) Patent No.: US 8,162,029 B2
(45) Date of Patent: Apr. 24, 2012

(54) FORGING APPARATUS AND FORGING METHOD FOR RHEOCASTING

(75) Inventor: Tae-Soo Ha, Daejeon (KR)

(73) Assignee: Rheoforge Co., Ltd., Jeollabuk-Do (KR)

( * ) Notice: Subject to any disclaimer, the term of this patent is extended or adjusted under 35 U.S.C. 154(b) by 0 days.

(21) Appl. No.: 12/996,948

(22) PCT Filed: Mar. 10, 2010

(86) PCT No.: PCT/KR2010/001502

§ 371 (c)(1),
(2), (4) Date: Dec. 8, 2010

(87) PCT Pub. No.: WO2011/025109

PCT Pub. Date: Mar. 3, 2011

(65) Prior Publication Data

US 2011/0214832 A1 Sep. 8, 2011

(51) Int. Cl.
*B22D 17/00* (2006.01)
*B22D 18/02* (2006.01)
*B22D 27/04* (2006.01)

(52) U.S. Cl. .... 164/76.1; 164/113; 164/120; 164/270.1; 164/284; 164/338.1

(58) Field of Classification Search ..... 164/76.1, 164/113, 120, 284, 270.1, 338.1
See application file for complete search history.

(56) References Cited

U.S. PATENT DOCUMENTS 7,797,832 B2 * 9/2010 Kamiya ..... 29/894.3

FOREIGN PATENT DOCUMENTS

| | | | |
|---|---|---|---|
| JP | 11-285805 | A | 10/1999 |
| KR | 10-2005-0067686 | A | 7/2005 |
| KR | 10-2006-0025596 | A | 3/2006 |
| KR | 10-0780738 | | 11/2007 |
| WO | WO 2008-123644 | A1 | 10/2008 |

OTHER PUBLICATIONS

English Language Abstract of JP 11-285805 A.
English Language Abstract of KR 10-2005-0067686 A.
English Language Abstract of KR 10-2006-0025596 A.
International Search Report of PCT/KR2010/001502 mailed on Oct. 18, 2010.

* cited by examiner

*Primary Examiner* — Kuang Lin
(74) *Attorney, Agent, or Firm* — Hershkovitz & Associates, LLC; Abraham Hershkovitz

(57) ABSTRACT

A forging apparatus and a forging method for rheo-casting are disclosed, in which primary rheo-casting using an upper mold and a lower mold, casting of a hub region of a product material using a first roller unit and casting of a rim region of the product material using a second roller unit are accomplished in series, enabling vehicular wheels having relatively complex shapes to be cast via a single casting process. Further, the product material includes wrought 6000 series aluminum alloys, which are easy to process and have relatively high strength and low weight, thus being suitable for the manufacture of vehicular wheels having complex shapes. Furthermore, recycling of the product material is possible.

3 Claims, 7 Drawing Sheets

FORGING APPARATUS AND FORGING METHOD FOR RHEOCASTING

TECHNICAL FIELD

The present invention relates to a forging apparatus for rheo-casting and a forging method using the same.

BACKGROUND ART

Casting is a process of making a cast, and proceeds in the sequence of preparation of a cast design, selection of a casting method, preparation of a mold, melting and pouring of a material, and finishing.

Non-ferrous metal casting methods include a gravity die casting method and a low pressure die casting method. The gravity die casting method and the low pressure die casting method have an advantage in that they enable manufacture of various shapes and sizes of products, but disadvantageously require high mold and molten material temperatures and an excessively long solidification time, thus causing inclusion of air bubbles into a product and generating cracks due to volume reduction during solidification.

As described above, the gravity die casting method and the low pressure die casting method entail deterioration in the density of a completed product and in mechanical properties and therefore, have failed to satisfy quality requirements of related industrial fields. In particular, the gravity die casting method and the low pressure die casting method could not comply with the recent tendency of automotive industries to manufacture relatively large and complex automotive components.

Despite the above described problems, currently, domestic and foreign automotive component manufacturers are manufacturing a great quantity of non-ferrous metal products, such as aluminum wheels, by use of the gravity die casting method and the low pressure die casting method. Use of these die casting methods consequently increases product defect rates and deteriorates mechanical properties of products, such as, e.g., cast structure, rigidity, elongation. For this reason, conventional gravity die casting method and low pressure die casting methods have been applied to manufacture of a limited range of products, such as small aluminum wheels (up to a maximum of 18 inches). In addition, delay of a product casting cycle time may occur since it is necessary to keep a mold temperature in the range of about 380° C. to 400° C. due to characteristics of the die casting methods and consequently, the gravity die casting method and the low pressure casting methods are unsuitable for mass production.

To solve the above described problems and to realize a low product weight, hot forging methods have been developed.

In a hot forging method to form an aluminum wheel, an aluminum billet is subjected to a cutting process, a heating process and a forming/pressurizing process using a hydraulic press in sequence. Due to adoption of direct casting of a solid material, the hot forging method may problematically require that casting processes be performed repeatedly, e.g., three or four times when it is attempted to form a complex product.

Furthermore, since it is necessary to repeatedly perform a thermal treatment several times in order to prevent work hardening, the hot forging method suffers from troublesome processes, high manufacturing costs, and increased facility costs for mass production, resulting in an increased product price. In conclusion, the hot forging method has difficulty in practical application for passenger motor vehicles and thus, has been used to manufacture wheels of commercial vehicles having relatively simple designs.

Disclosure of Invention Technical Problem

An object of the present invention devised to solve the problem lies on a forging apparatus and a forging method for rheo-casting, which enable rheo-casting of a relatively complex vehicular wheel via a single casting process.

Another object of the present invention devised to solve the problem lies on a forging apparatus and a forging method for rheo-casting, which enable recycling of a semisolid product material.

Technical Solution

The object of the present invention can be achieved by providing A forging apparatus for rheo-casting including a bed, a base installed on the bed, a lower mold installed on the base, into which a product material is poured, guides installed on the bed at both sides of the base, a side holder block installed on each of the guides so as to slide on the guide, a side holder coupled to the side holder block so as to be moved along with the side holder block, the side holder enabling casting of a rim region of the product material when being located on the lower mold, a hydraulic cylinder installed above the bed and connected to the side holder block, the hydraulic cylinder serving to reciprocally move the side holder block and the side holder toward or away from the lower mold, a lower actuating shaft having an upper surface located at the center of the lower mold to define a bottom surface of the lower mold, the lower actuating shaft being rotatable along with the product material and being moved upward to separate the product material, which has been subjected to primary rheo-casting, from the lower mold, an elevating cylinder connected to the lower actuating shaft to move the lower actuating shaft upward or downward, a rotation device connected to the lower actuating shaft and the elevating cylinder to rotate the same, an upper actuating shaft installed on a center axis of the lower actuating shaft so as to be moved upward or downward, the upper actuating shaft supporting an upper portion of the product material, an ejection punch installed to a lower end of the upper actuating shaft, an ejection cylinder connected to the ejection punch to move the ejection punch upward or downward, an upper mold holder fixed to the upper actuating shaft, an upper mold fixed to the upper mold holder and adapted to be moved upward or downward along with the upper actuating shaft to enable the primary rheo-casting of the product material received in the lower mold, a hub heating burner to heat a hub region of the product material by being moved to the hub region when the product material, which has been subjected to the primary rheo-casting, is moved upward along with the upper mold, a first roller unit installed to be moved in horizontal and vertical directions below the hub region of the product material, so as to cast the hub region of the product material by applying pressure to the hub region while the hub region of the product material heated by the hub heating roller is being rotated about the lower actuating shaft, a first transfer robot connected to the first roller unit to move the first roller unit in horizontal and vertical directions, a rim heating burner to heat the rim region of the product material by being moved to the rim region when the product material, which has been subjected to the primary rheo-casting, is moved upward along with the upper mold, a second roller unit installed to be moved in horizontal and vertical directions at one side of the rim region of the product material, so as to cast the rim region of the product material by applying pressure to the rim region while the rim region of the product material heated by the rim heating roller is being rotated about the lower actuating shaft, a second transfer robot connected to the second roller unit to move the second roller unit in horizontal and vertical directions, and a catcher installed to be reciprocally moved in a horizontal direction between the lower mold and the upwardly moved upper mold, to allow the product material separated from the upper mold to be seated thereon.

The product material may include wrought 6000 series aluminum alloys.

In another aspect of the present invention, provided herein is a forging method for rheo-casting using a forging apparatus including a lower mold installed on a base, into which a product material is poured, a side holder coupled to a side holder block so as to be reciprocally moved toward or away from the lower mold along with the side holder block, a hydraulic cylinder connected to the side holder block to reciprocally move the side holder toward or away from the lower mold, a lower actuating shaft having an upper surface located at the center of the lower mold and adapted to be rotated and moved upward or downward along with a cast product material, an upper actuating shaft installed on a center axis of the lower actuating shaft so as to be moved upward or downward, an ejection punch installed to a lower end of the upper actuating shaft, an ejection cylinder connected to the ejection punch to move the ejection punch upward or downward, an upper mold adapted to be moved upward or downward along with the upper actuating shaft to enable primary rheo-casting of the product material received in the lower mold, a hub heating burner to heat a hub region of the product material by being moved to the hub region when the product material, which has been subjected to primary rheo-casting, is moved upward along with the upper mold, a first roller unit installed to be moved in horizontal and vertical directions below the hub region of the product material, so as to cast the hub region of the product material by applying pressure to the heated hub region, a rim heating burner to heat a rim region of the product material by being moved to the rim region when the product material, which has been subjected to primary rheo-casting, is moved upward along with the upper mold, a second roller unit installed to be moved in horizontal and vertical directions at one side of the rim region of the product material, so as to cast the rim region of the product material by applying pressure to the heated rim region, and a catcher installed to be reciprocally moved in a horizontal direction between the lower mold and the upwardly moved upper mold, the forging method including pouring a product material into the lower mold, the product material being a semi-solid material to be forged, performing primary rheo-casting on the product material poured into the lower mold by moving the upper mold downward, separating the side holder from the lower mold by operating the hydraulic cylinder after the primary rheo-casting of the product material, moving the product material, having undergone the primary rheocasting, and the upper mold upward by moving the lower actuating shaft and the upper actuating shaft upward after the side holder is separated from the lower mold, heating the hub region of the product material while rotating the product material by moving the hub heating burner to the underside of the hub region and rotating the lower actuating shaft after upward movement of the product material, pressing and casting the heated hub region of the product material while moving the first roller unit in horizontal and vertical directions, heating the rim region of the product material by moving the rim heating burner to the rim region after casting of the hub region of the product material, pressing and casting the heated rim region of the product material while moving the second roller unit in horizontal and vertical directions, moving the lower actuating shaft downward after a product is completed via casting of the hub region and the rim region of the product material, horizontally moving the catcher to a position below the product after downward movement of the lower actuating shaft, and moving the ejection punch downward by the ejection cylinder when the catcher reaches the underside of the product, thus allowing the product to be separated from the upper mold and be seated on the catcher.

Advantageous Effects

As apparent from the above description, a forging apparatus and a forging method for rheo-casting according to the present invention have the following effects.

Once a product material is subjected to primary rheo-casting by an upper mold and a lower mold, the product material is moved upward so that a hub region of the product material is heated by a hub heating burner. The hub region of the product material is pressed and cast via horizontal and vertical movements of a first roller unit. Subsequently, after a rim region of the product material is heated by a rim heating burner, the rim region of the product material is pressed and cast via horizontal and vertical movements of a second roller unit.

Accordingly, the primary rheo-casting using the upper mold and the lower mold, the casting of the hub region using the first roller unit and the casting of the rim region using the second roller unit can be accomplished in series, enabling vehicular wheels having relatively complex shapes to be cast via a single casting process.

Further, according to the present invention, the product material includes wrought 600 series aluminum alloys. The product material is easy to process and has relatively high strength and low weight, thus being suitable for the manufacture of complex vehicular wheels. In addition, the product material can be recycled and can enhance price competitiveness owing to low manufacturing costs thereof.

BRIEF DESCRIPTION OF DRAWINGS

The accompanying drawings, which are included to provide a further understanding of the invention, illustrate embodiments of the invention and together with the description serve to explain the principle of the invention.

In the drawings.

BEST MODE FOR CARRYING OUT THE INVENTION

Reference will now be made in detail to characteristics and advantages of the preferred embodiment of the present invention, examples of which are illustrated in the accompanying drawings.

Figure 11:
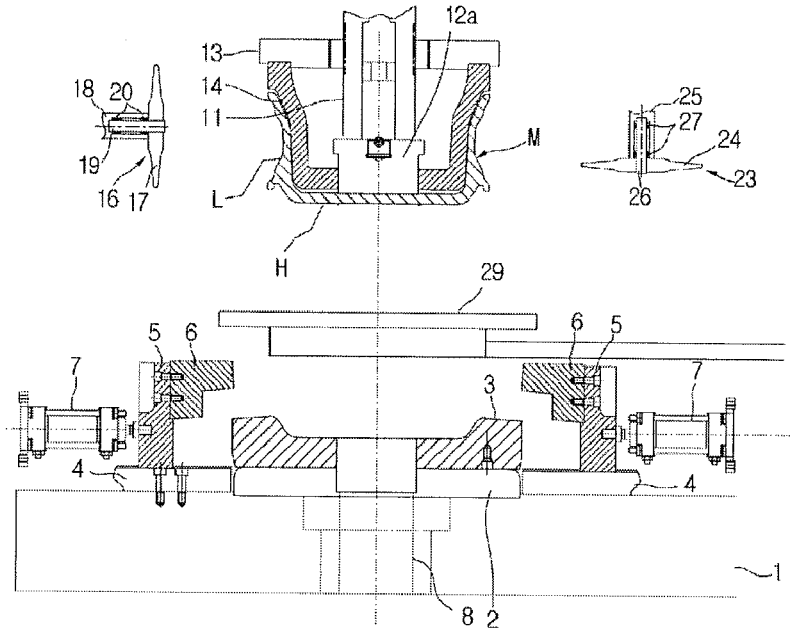
Figure 12:
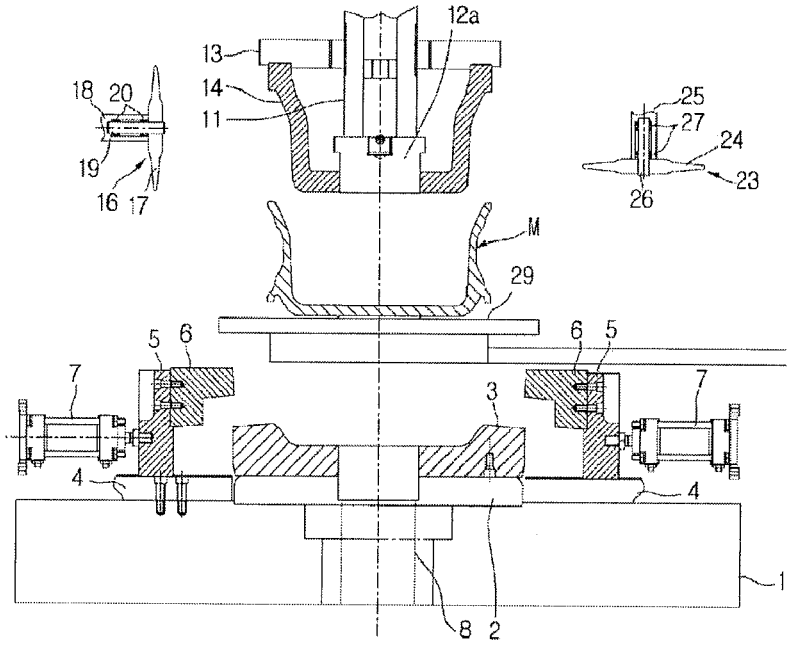
Figure 13:
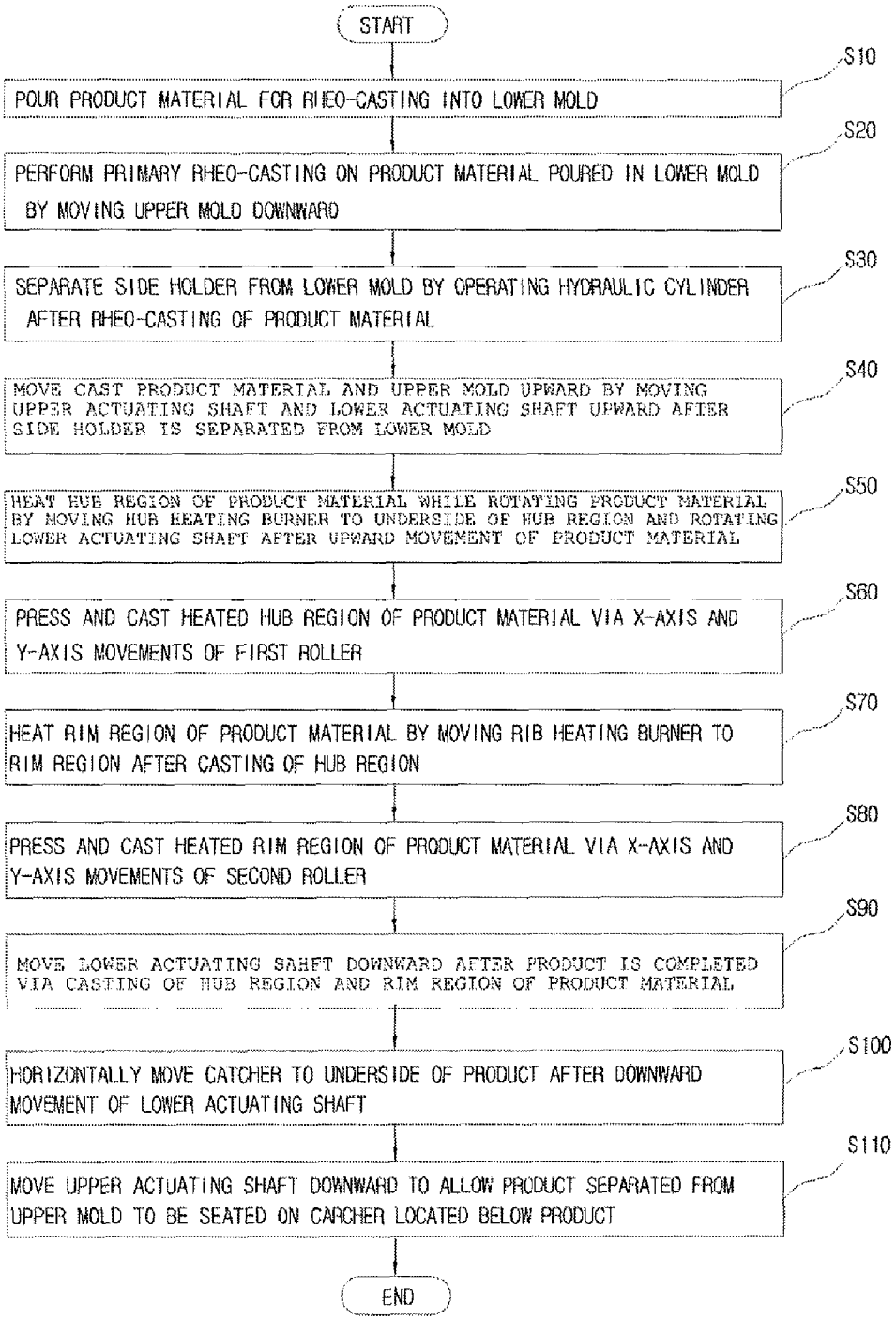
FIG. 13 is a flow chart illustrating the sequence of the forging method for rheocasting according to the present invention.

FIGS. 1 to 12 are schematic sectional views illustrating the sequence of a forging method using a forging apparatus for rheo-casting according to the present invention, and FIG. 13 is a flow chart illustrating the sequence of the forging method for rheocasting according to the present invention.

The forging apparatus for rheo-casting according to the present invention includes a bed 1, and a base 2 installed on the bed 1. A lower mold 3 is installed on the base 2, into which a product material PM is poured.

Here, the product material PM includes wrought 6000 series aluminum alloys. The wrought 6000 series aluminum alloys have easier processability and higher strength than other aluminum alloys and thus, are suitable for use in automotive components. The wrought aluminum alloys are Al—Mg—Si based alloys, which have superior strength and corrosion resistance.

Accordingly, the product material PM of the present invention is easy to process and has relatively high strength and low weight, thus being suitable for the manufacture of vehicular wheels having complex shapes. The product material PM can be recycled without billet preparation equipment and can enhance price competitiveness owing to low manufacturing costs thereof.

Guides 4 are installed respectively at both sides of the base 2, and side holder blocks 5 are installed on the respective guides 4. Each of the guides 4 has a pair of guidance grooves 4*a* indented in both edge regions thereof, and each of the side holder blocks 5 has a pair of guidance protrusions 5*a* protruding from both edge regions thereof. Accordingly, the side holder block 4 is adapted to slide on the corresponding guide 4 in a state wherein the guidance protrusions 5*a* are fitted in the guidance grooves 4*a* respectively. Side holders 6 are mounted to the side holder blocks 5. The side holders 6 are moved on the respective guides 4 along with the side holder blocks 5 and serve to cast a rim region L of the product material PM when being located on the lower mold 3. Both of the side holders 6 are simultaneously moved toward and are coupled to the lower mold 3, or are simultaneously moved away from and are separated from the lower mold 3.

Hydraulic cylinders 7 are arranged above the bed 1. The hydraulic cylinders 7 are connected to the respective side holder blocks 5 to reciprocally move the side holder blocks 5 and the side holders 6 on the guides 4 toward or away from the lower mold 3.

A lower actuating shaft 8 is upwardly or downwardly movably installed through the bed 1, the base 2 and the lower mold 3. The lower actuating shaft 8 is located at the center of the lower mold 3 so that an upper surface of the lower actuating shaft 8 defines a bottom surface of the lower mold 3. When it is desired to separate the cast semi-solid product material PM from the lower mold 3, the lower actuating shaft 8 is moved upward. The lower actuating shaft 8 is rotatable along with the product material PM.

An elevating cylinder 9 is connected to the lower actuating shaft 8 to enable upward or downward movement of the lower actuating shaft 8. A rotation device 10 is installed to the lower actuating shaft 8 and the elevating cylinder 9 to rotate the same. The rotation device 10 may be selected from various configurations capable of rotating the lower actuating shaft 8. For example, gears or belts may be used to transmit rotation power of a drive motor to the lower actuating shaft 8.

An upper actuating shaft 11 is arranged on a center axis of the lower actuating shaft 8 and is movable upward or downward. An ejection punch 12*a* is installed to a lower end of the upper actuating shaft 11 and in turn, an ejection cylinder 12 is connected to the ejection punch 12*a* to enable upward or downward movement of the ejection punch 12*a*.

An upper mold holder 13 is fixed to the upper actuating shaft 11 and in turn, an upper mold 14 is fixed to the upper mold holder 13. Accordingly, the upper mold 14 is moved upward or downward along with the upper actuating shaft 11 and cooperates with the lower mold 3 so that the product material PM received in the lower mold 3 is subjected to primary rheo-casting.

A hub heating burner 15 is provided to heat a hub region H of the product material PM. Once the product material PM is completely subjected to the primary rheo-casting and is moved upward along with the upper mold 14 by the lower actuating shaft 8, the hub heating burner 15 is moved to the hub region H of the product material PM to heat the hub region H. The hub heating burner 15 is connected to a fuel supply tank (not shown) by means of a hose to supply fuel into the hub heating burner 15. In addition, a transfer device (not shown) to move the hub heating burner 15 to the hub region H of the product material PM is connected to the hub heating burner 15. The transfer device may be selected from among various configurations capable of reciprocally moving the hub heating burner 15 toward or away from the hub region H.

A first roller unit 16 is provided to cast the hub region H of the product material PM. To this end, after the hub region H of the product material PM is heated by the hub heating burner 15, the first roller unit 16 applies pressure to the hub region H while the product material PM is being rotated about the lower actuating shaft 8. The first roller unit 16 is installed so as to be located below the hub region H of the product material PM in a state wherein the product material PM is moved upward by the lower actuating shaft 8. The first roller unit 16 is movable in horizontal and vertical directions.

The first roller unit 16 includes a first roller 17 to cast the hub region H of the product material PM by applying pressure to the hub region H, a first rotating shaft 19 to support the first roller 17 so as to enable idle running of the first roller 17, a first bearing 20 coupled around the first rotating shaft 19 to support the first rotating shaft 19 so as to enable idle running of the first rotating shaft 19, and a first supporting shaft 18 to support the first rotating shaft 19 with the first bearing 20 interposed therebetween.

A first transfer robot 21 is connected to the first roller unit 16. The first transfer robot 21 moves the first roller unit 16 in horizontal and vertical directions, allowing the first roller unit 16 to press and cast the hub region H of the product material PM.

A rim heating burner 22 is installed to heat the rim region L of the product material PM. To this end, the rim heating burner 22 is moved to the rim region L of the product material PM when the product material PM, which has been subjected to the primary rheocasting, is moved upward along with the upper mold 14. The rim heating burner 22 is connected to the fuel supply tank (not shown) by means of a hose to supply fuel into the rim heating burner 22. In addition, a transfer device (not shown) to move the rim heating burner 22 to the rim region L of the product material PM is connected to the rim heating burner 22. The transfer device may be selected from among various configurations capable of reciprocally moving the rim heating burner 22 toward or away from the rim region L.

A second roller unit 23 is provided to cast the rim region L of the product material PM. To this end, after the rim region L of the product material PM is heated by the rim heating burner 22, the second roller unit 23 applies pressure to the rim region L while the product material PM is being rotated about the lower actuating shaft 8. The second roller unit 23 is installed so as to be located at one side of the rim region L of the product material PM in a state wherein the product material PM is moved upward by the lower actuating shaft 8. The second roller unit 23 is movable in horizontal and vertical directions.

The second roller unit 23 includes a second roller 24 to cast the rim region L of the product material PM by applying pressure to the rim region L, a second rotating shaft 26 to support the second roller 24 so as to enable idle running of the second roller 24, a second bearing 27 coupled around the second rotating shaft 26 to support the second rotating shaft 26 so as to enable idle running of the second rotating shaft 26, and a second supporting shaft 25 to support the second rotating shaft 26 with the second bearing 27 interposed therebetween.

A second transfer robot 28 is connected to the second roller unit 23. The second transfer robot 28 moves the first roller unit 23 in horizontal and vertical directions, allowing the second roller unit 23 to press and cast the rim region L of the product material PM.

A catcher 29 is interposed between the lower mold 3 and the upper mold 14 under the assumption that the upper mole 14 is moved upward. The catcher 29 is reciprocally movable in a horizontal direction. The catcher 29 is moved to the underside of the product material PM when the lower actuating shaft 8 is moved downward from an upwardly moved position thereof, thus allowing the product material PM separated from the upper mold 14 to be seated thereon.

FIG. 13 is a flow chart illustrating the sequence of the forging method for rheocasting according to the present invention. Hereinafter, the forging method for rheocasting according to the present invention will be described with reference to FIGS. 1 to 13 which illustrating the sequence of the forging method.

First, the forging method includes a product material pouring operation S10 for pouring the semi-solid product material PM into the lower mold 3. The poured product material PM includes wrought 6000 series aluminum alloys. The wrought 6000 series aluminum alloys are easy to process and have relatively high strength and low weight, thus being suitable for the manufacture of vehicular wheels having complex shapes. The product material PM can be recycled without billet preparation equipment.

Figure 1:
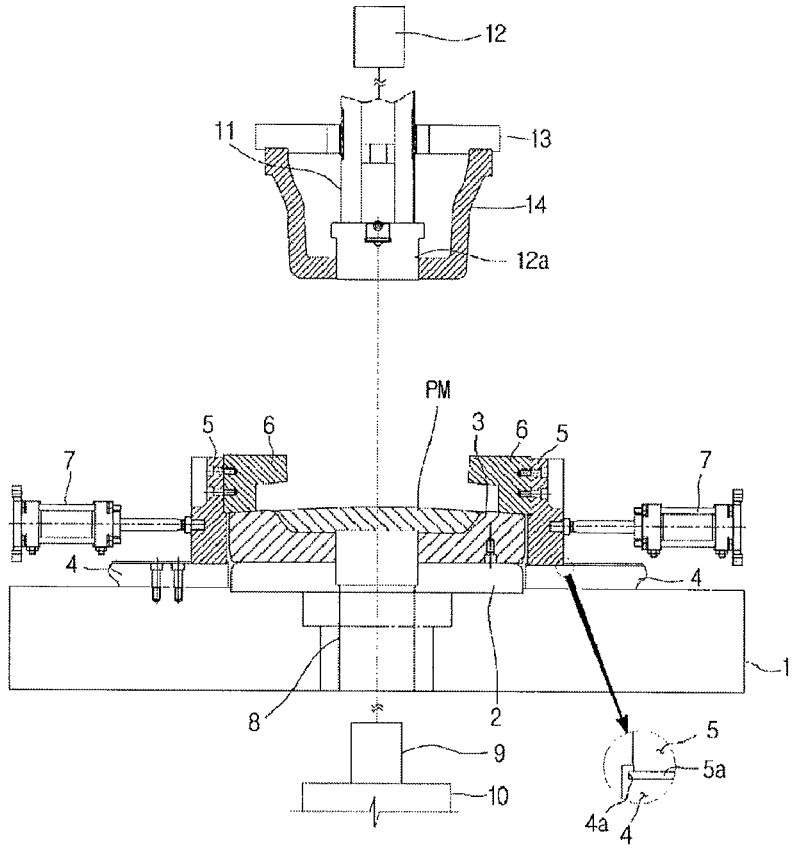
FIGS. 1 to 12 are schematic sectional views illustrating the sequence of a forging method using a forging apparatus for rheo-casting according to the present invention.
Figure 2:
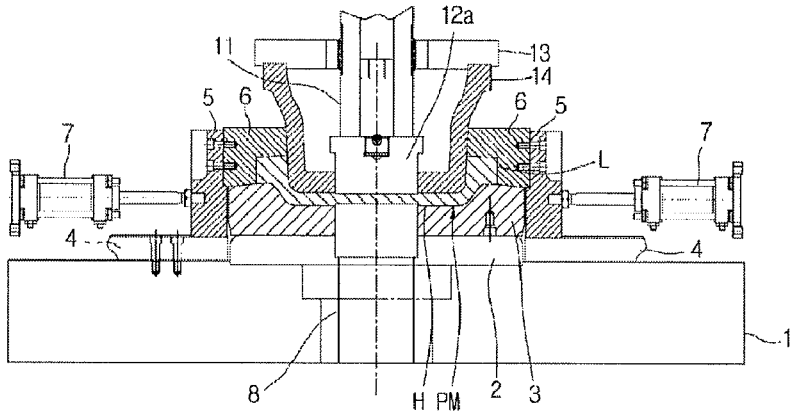

After the product material PM is poured into the lower mold 3, as illustrated in FIG. 2, a rheo-casting operation S20 is carried out, in which the upper mold 14 is moved downward and cooperates with the lower mold 3 for primary rheo-casting of the product material PM received in the lower mold 3. Specifically, as the upper actuating shaft 11 is moved downward via operation of the ejection cylinder 12, the upper mold holder 13 and the upper mold 14 are moved downward to press the product material PM received in the lower mold 3, enabling implementation of the primary rheocasting.

Figure 3:
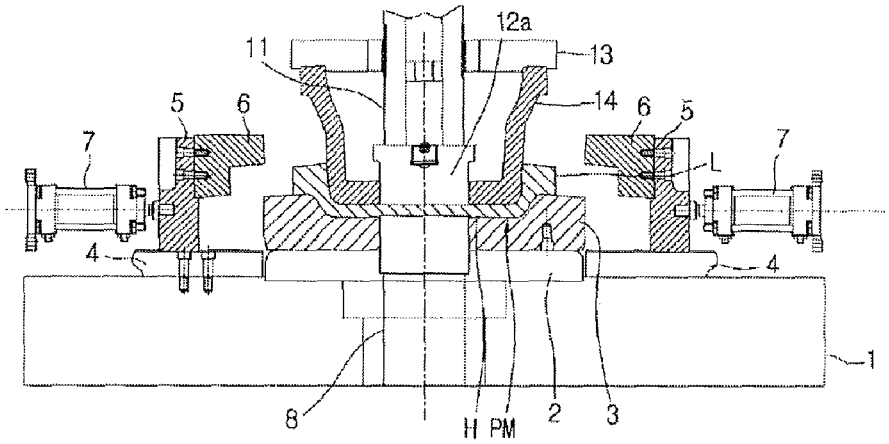

After completion of the primary rheo-casting of the product material PM, as illustrated in FIG. 3, a side holder separation operation S30 is carried out to separate the side holders 6 from the lower mold 3 via operation of the hydraulic cylinders 7. Specifically, as the hydraulic cylinders 7 are operated to slide the side holder blocks 5 and the side holders 6 on the guides 4, the side holder blocks 5 and the side holders 6 are moved away from the lower mold 3, allowing the periphery of the product material PM to be exposed to the outside.

Figure 4:
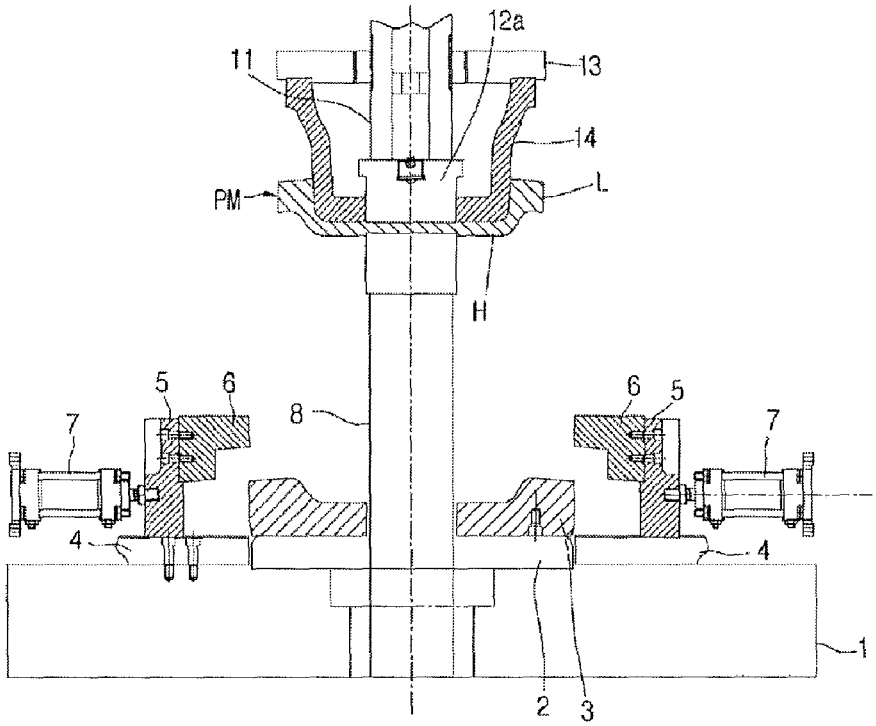

After the side holders 6 are separated from the lower mold 3, as illustrated in FIG. 4, a product material upward movement operation S40 is carried out, in which the lower actuating shaft 8 and the upper actuating shaft 11 are moved upward to move the product material PM having undergone the primary rheo-casting and the upper mold 14. Specifically, as the lower actuating shaft 8 is moved upward via operation of the elevating cylinder 9, the product material PM is separated from the lower mold 3, and then, the product material PM, the upper mold 14 and the upper actuating shaft 11 are moved upward together.

Figure 5:
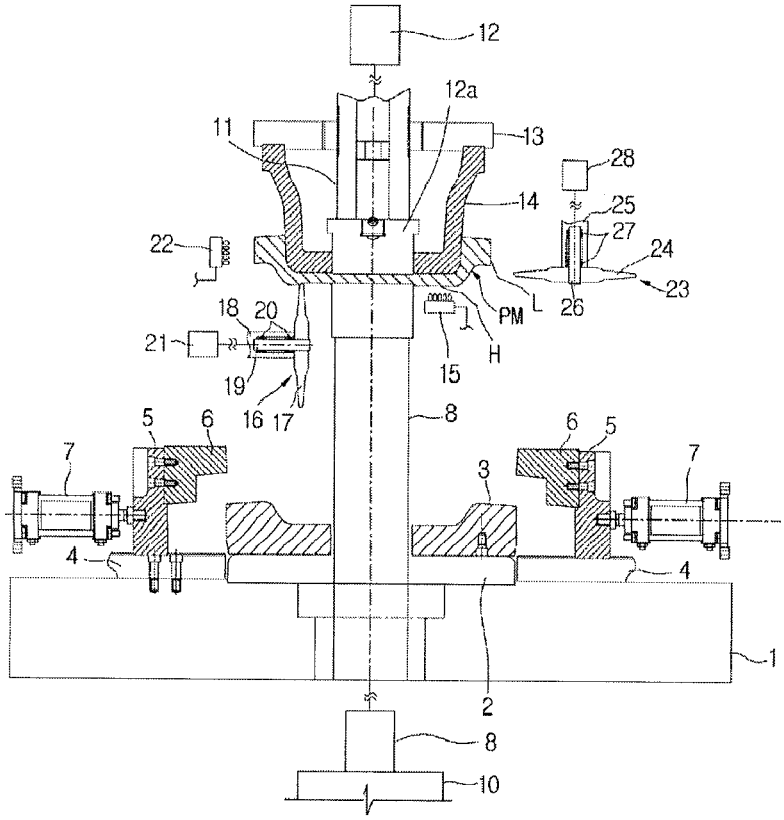

After the upward movement of the product material PM is completed, as illustrated in FIG. 5, a hub heating operation S50 is carried out, in which the hub heating burner 15 is moved to the underside of the hub region H of the product material PM and the lower actuating shaft 8 is rotated to rotate the product material PM so that the hub region H is heated during rotation of the product material PM. The lower actuating shaft 8, the product material PM, the upper mold 14 and the upper actuating shaft 11 are rotated together by rotation of the rotation device 10, to support the product material PM supported on the lower actuating shaft 8. Here, simultaneous rotation of the product material PM, the upper mold 14 and the upper actuating shaft 11 is accomplished by frictional force between closely contacting components during rotation of the lower actuating shaft 8. Alternatively, an additional rotation device may be installed to rotate the upper actuating shaft 11, to allow the upper actuating shaft 11 to be rotated upon rotation of the lower actuating shaft 8.

Figure 6:
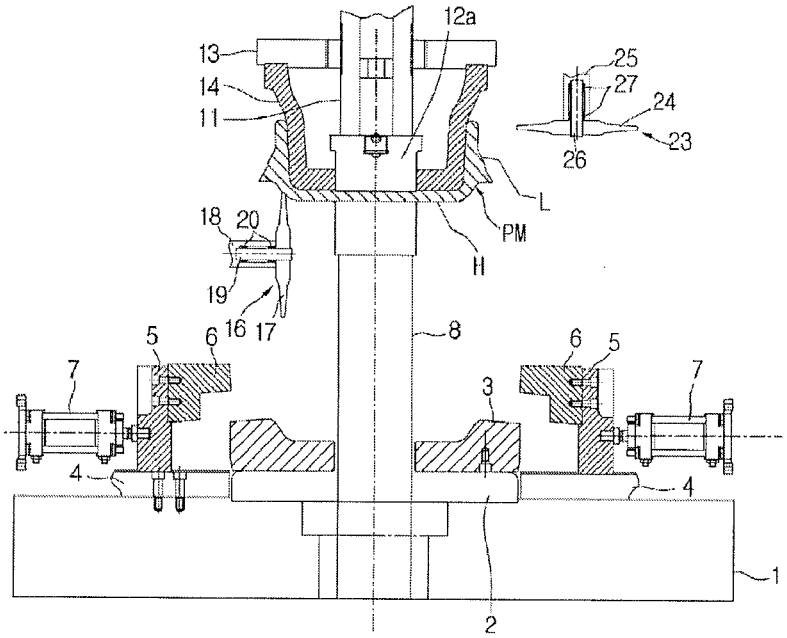
Figure 7:
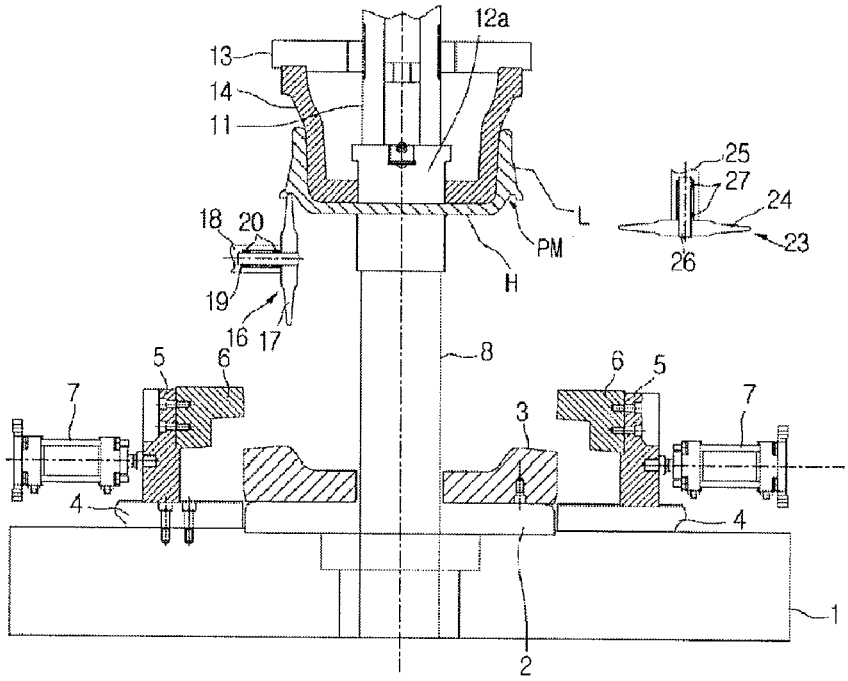

After the hub region H of the product material PM is heated, as illustrated in FIGS. 5 to 7, a hub casting operation S60 is carried out, in which the first roller unit 16 acts to press the hub region H of the product material PM while being moved in horizontal and vertical directions. Specifically, in a state wherein the first roller 17 is brought into close contact with the hub region H of the product material PM via operation of the first transfer robot 21, the first roller 17 can press and cast the hub region H while being moved outward from the center of the underside of the hub region H.

After the hub region H of the product material PM is completely cast, as illustrated in FIG. 5, a rim heating operation S70 is carried out, in which the rim heating burner 22 is moved to heat the rim region L of the product material PM.

Figure 8:
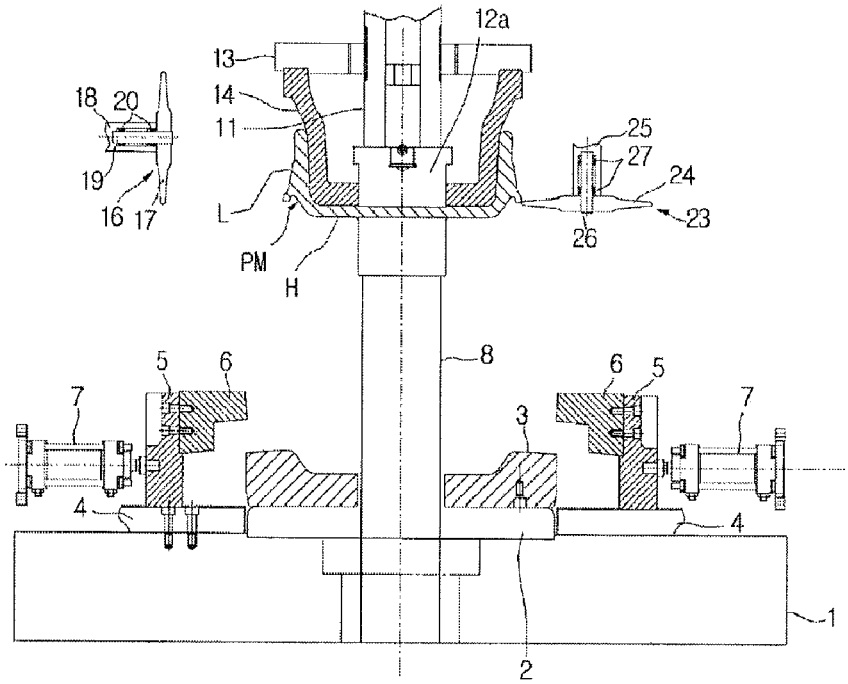
Figure 9:
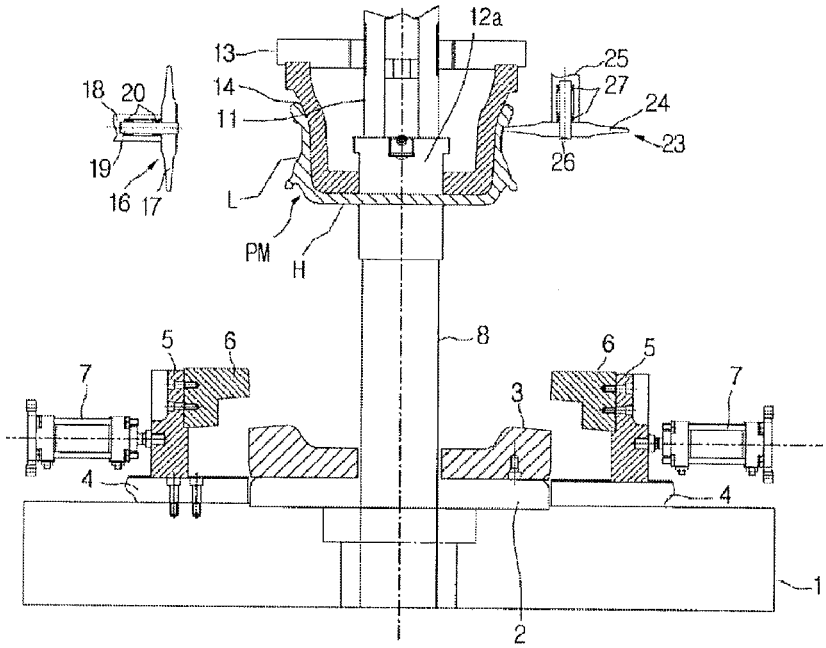
Figure 10:
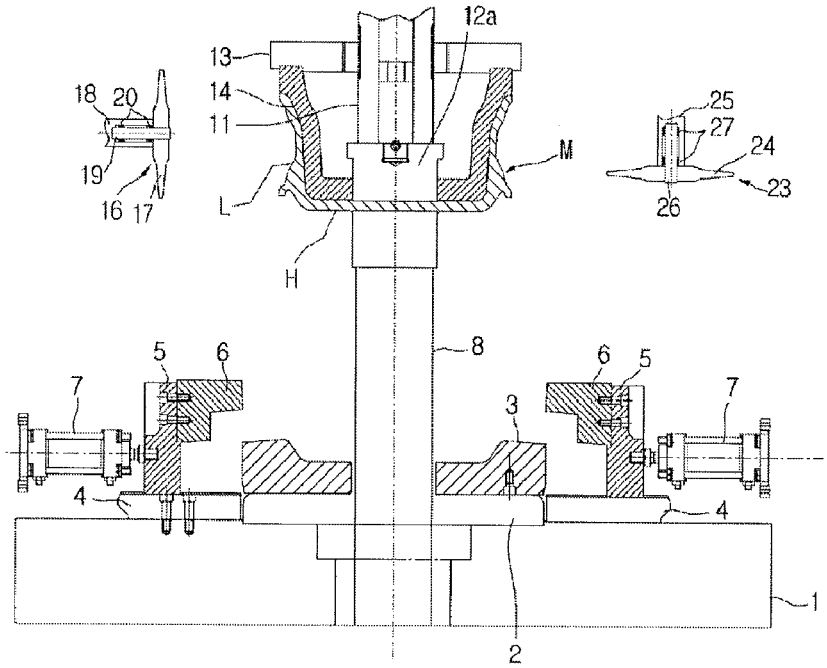

After the rim region L of the product material PM is heated, as illustrated in FIGS. 8 to 10, a rim casting operation S80 is carried out, in which the second roller unit 23 acts to press the rim region L of the product material PM while being moved in horizontal and vertical directions. Specifically, in a state wherein the second roller 24 is brought into close contact with the rim region L of the product material PM via operation of the second transfer robot 28, the second roller 24 can press and cast the rim region L while being moved upward from a lower end of the rim region L.

After the hub region H and the rim region L of the product material PM are cast to complete a product M, as illustrated in FIG. 11, a lower actuating shaft downward movement operation S90 is carried out to move the lower actuating shaft 8 downward. Specifically, the lower actuating shaft 8 is moved downward via operation of the elevating cylinder 9, allowing the completed product M to drop and acquiring a space for reciprocal movement of the catcher 29.

After the lower actuating shaft 8 is moved downward, a catcher transfer operation S100 is carried out to horizontally move the catcher 29 to a position below the product M.

After the catcher 29 reaches below the product M, as illustrated in FIGS. 11 and 12, an ejection operation S110 is carried out, in which the ejection punch 12*a* is moved downward via operation of the ejection cylinder 12, acting to separate the product M from the upper mold 14 and allowing the product M to be seated on the catcher 29.

MODE FOR THE INVENTION

Various embodiments have been described in the best mode for carrying out the invention.

INDUSTRIAL APPLICABILITY

The forging apparatus and the forging method for rheo-casting according to the present invention has the following several effects.

Once the product material PM is subjected to primary rheo-casting by the upper mold 14 and the lower mold 3, the product material PM is moved upward so that the hub region H of the product material PM is heated by the hub heating burner 15. The hub region H of the product material PM is pressed and cast via horizontal and vertical movements of the first roller unit 16. Subsequently, after the rim region L of the product material PM is heated by the rim heating burner 22, the rim region L of the product material PM is pressed and cast via horizontal and vertical movements of the second roller unit 23.

Accordingly, the primary rheo-casting using the upper mold 14 and the lower mold 3, the casting of the hub region H using the first roller unit 16 and the casting of the rim region L using the second roller unit 23 can be accomplished in series, enabling vehicular wheels having relatively complex shapes to be cast via a single casting process.

Further, according to the present invention, the product material PM includes wrought 600 series aluminum alloys. The product material PM is easy to process and has relatively high strength and low weight, thus being suitable for the manufacture of complex vehicular wheels. In addition, the product material PM can be recycled and can enhance price competitiveness owing to low manufacturing costs thereof.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

The invention claimed is:

1. A forging apparatus for rheo-casting comprising:

a bed;

a base installed on the bed;

a lower mold installed on the base, into which a product material is poured;

guides installed on the bed at both sides of the base;

a side holder block installed on each of the guides so as to slide on the guide;

a side holder coupled to the side holder block so as to be moved along with the side holder block, the side holder enabling casting of a rim region of the product material when being located on the lower mold;

a hydraulic cylinder installed above the bed and connected to the side holder block, the hydraulic cylinder serving to reciprocally move the side holder block and the side holder toward or away from the lower mold;

a lower actuating shaft having an upper surface located at the center of the lower mold to define a bottom surface of the lower mold, the lower actuating shaft being rotatable along with the product material and being moved upward to separate the product material, which has been subjected to primary rheo-casting, from the lower mold;

an elevating cylinder connected to the lower actuating shaft to move the lower actuating shaft upward or downward;

a rotation device connected to the lower actuating shaft and the elevating cylinder to rotate the same;

an upper actuating shaft installed on a center axis of the lower actuating shaft so as to be moved upward or downward, the upper actuating shaft supporting an upper portion of the product material;

an ejection punch installed to a lower end of the upper actuating shaft;

an ejection cylinder connected to the ejection punch to move the ejection punch upward or downward;

an upper mold holder fixed to the upper actuating shaft;

an upper mold fixed to the upper mold holder and adapted to be moved upward or downward along with the upper actuating shaft to enable the primary rheocasting of the product material received in the lower mold;

a hub heating burner to heat a hub region of the product material by being moved to the hub region when the product material, which has been subjected to the primary rheo-casting, is moved upward along with the upper mold;

a first roller unit installed to be moved in horizontal and vertical directions below the hub region of the product material, so as to cast the hub region of the product material by applying pressure to the hub region while the hub region of the product material heated by the hub heating burner is being rotated about the lower actuating shaft;

a first transfer robot connected to the first roller unit to move the first roller unit in horizontal and vertical directions;

a rim heating burner to heat the rim region of the product material by being moved to the rim region when the product material, which has been subjected to the primary rheo-casting, is moved upward along with the upper mold;

a second roller unit installed to be moved in horizontal and vertical directions at one side of the rim region of the product material, so as to cast the rim region of the product material by applying pressure to the rim region while the rim region of the product material heated by the rim heating burner is being rotated about the lower actuating shaft;

a second transfer robot connected to the second roller unit to move the second roller unit in horizontal and vertical directions; and a catcher installed to be reciprocally moved in a horizontal direction between the lower mold and the upwardly moved upper mold, to allow the product material separated from the upper mold to be seated thereon.

2. The forging apparatus according to claim 1, wherein:

the product material includes Al—Mg—Si based alloys of wrought 6000 series aluminum alloys; and each of the guides has a pair of guidance grooves indented in both edge regions thereof, and each of the side holder blocks has a pair of guidance protrusions protruding from both edge regions thereof to be fitted in the respective guidance grooves so as to allow the side holder block to slide on the corresponding guide.

3. A forging method for rheo-casting using a forging apparatus comprising a lower mold installed on a base, into which a product material is poured, a side holder coupled to a side holder block so as to be reciprocally moved toward or away from the lower mold along with the side holder block, a hydraulic cylinder connected to the side holder block to reciprocally move the side holder toward or away from the lower mold, a lower actuating shaft having an upper surface located at the center of the lower mold and adapted to be rotated and moved upward or downward along with a cast product material, an upper actuating shaft installed on a center axis of the lower actuating shaft so as to be moved upward or downward, an ejection punch installed to a lower end of the upper actuating shaft, an ejection cylinder connected to the ejection punch to move the ejection punch upward or downward, an upper mold adapted to be moved upward or downward along with the upper actuating shaft to enable primary rheo-casting of the product material received in the lower mold, a hub heating burner to heat a hub region of the product material by being moved to the hub region when the product material, which has been subjected to primary rheo-casting, is moved upward along with the upper mold, a first roller unit installed to be moved in horizontal and vertical directions below the hub region of the product material, so as to cast the hub region of the product material by applying pressure to the heated hub region, a rim heating burner to heat a rim region of the product material by being moved to the rim region when the product material, which has been subjected to primary rheo-casting, is moved upward along with the upper mold, a second roller unit installed to be moved in horizontal and vertical directions at one side of the rim region of the product material, so as to cast the rim region of the product material by applying pressure to the heated rim region, and a catcher installed to be reciprocally moved in a horizontal direction between the lower mold and the upwardly moved upper mold, the forging method comprising:

pouring a product material into the lower mold, the product material being a semi-solid material to be forged;

performing primary rheo-casting on the product material poured into the lower mold by moving the upper mold downward;

separating the side holder from the lower mold by operating the hydraulic cylinder after the primary rheo-casting of the product material;

moving the product material, having undergone the primary rheo-casting, and the upper mold upward by moving the lower actuating shaft and the upper actuating shaft upward after the side holder is separated from the lower mold;

heating the hub region of the product material while rotating the product material by moving the hub heating burner to the underside of the hub region and rotating the lower actuating shaft after upward movement of the product material;

pressing and casting the heated hub region of the product material while moving the first roller unit in horizontal and vertical directions;

heating the rim region of the product material by moving the rim heating burner to the rim region after casting of the hub region of the product material;

pressing and casting the heated rim region of the product material while moving the second roller unit in horizontal and vertical directions;

moving the lower actuating shaft downward after a product is completed via casting of the hub region and the rim region of the product material;

horizontally moving the catcher to a position below the product after downward movement of the lower actuating shaft; and moving the ejection punch downward by the ejection cylinder when the catcher reaches the underside of the product, thus allowing the product to be separated from the upper mold and be seated on the catcher.

* * * * *